US010400797B2

(12) United States Patent
Udagawa et al.

(10) Patent No.: US 10,400,797 B2
(45) Date of Patent: Sep. 3, 2019

(54) HYDRAULIC CONTROL SYSTEM FOR WORKING MACHINE

(71) Applicant: Hitachi Construction Machinery Co., Ltd., Taito-ku, Tokyo (JP)

(72) Inventors: Tsutomu Udagawa, Ibaraki (JP); Hiroaki Tanaka, Ibaraki (JP); Yasutaka Tsuruga, Ibaraki (JP); Kazunori Nakamura, Ibaraki (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 15/563,631

(22) PCT Filed: Apr. 3, 2015

(86) PCT No.: PCT/JP2015/060654
§ 371 (c)(1),
(2) Date: Oct. 2, 2017

(87) PCT Pub. No.: WO2016/157531
PCT Pub. Date: Oct. 6, 2016

(65) Prior Publication Data

US 2018/0073525 A1 Mar. 15, 2018

(51) Int. Cl.
*F15B 11/17* (2006.01)
*E02F 9/22* (2006.01)
*F15B 11/02* (2006.01)

(52) U.S. Cl.
CPC ..... *F15B 11/17* (2013.01); *E02F 9/2221* (2013.01); *E02F 9/2235* (2013.01);
(Continued)

(58) Field of Classification Search
None
See application file for complete search history.

(56) References Cited

U.S. PATENT DOCUMENTS

2012/0291427 A1 11/2012 Azuma et al.
2014/0090369 A1 4/2014 Nakamura et al.
(Continued)

FOREIGN PATENT DOCUMENTS

EP 2 535 468 A1 12/2012
JP 57-54635 A 4/1982
(Continued)

OTHER PUBLICATIONS

International Search Report (PCT/ISA/210) issued in PCT Application No. PCT/JP2015/060654 dated Jun. 20, 2015 with English translation (3 pages).
(Continued)

*Primary Examiner* — John Olszewski
*Assistant Examiner* — Gerrad A Foster
(74) *Attorney, Agent, or Firm* — Crowell & Moring LLP

(57) ABSTRACT

To provide a hydraulic control system for a working machine with high fuel efficiency and higher versatility to be capable of being adapted to special work. The hydraulic control system for the working machine according to the present invention includes: a plurality of directional control valves (31, 32, . . . ), more than one of which is connected in parallel to each of a plurality of hydraulic pumps (11, 12, 13) to supply hydraulic oil from the hydraulic pump to each of the corresponding actuators (4, 5, 6, 50); operating devices (110, 120, 130, 140) to which an operator inputs manipulated variables; a connection map (182) storing a precedence order for connection between a plurality of hydraulic pumps and a plurality of directional control valves; and a controller (100) controlling the connection conditions of the pumps and the actuators on the basis of the connection a¥map and operation signals.

3 Claims, 10 Drawing Sheets

(52) U.S. Cl.
CPC ..... *E02F 9/2242* (2013.01); *E02F 9/2292* (2013.01); *E02F 9/2296* (2013.01); *F15B 11/02* (2013.01); *F15B 2211/20576* (2013.01); *F15B 2211/2654* (2013.01); *F15B 2211/30595* (2013.01); *F15B 2211/6346* (2013.01); *F15B 2211/6652* (2013.01); *F15B 2211/6654* (2013.01); *F15B 2211/7142* (2013.01); *F15B 2211/75* (2013.01)

(56) References Cited

U.S. PATENT DOCUMENTS

| | | | |
|---|---|---|---|
| 2016/0025113 | A1 | 1/2016 | Hiraku et al. |
| 2016/0032565 | A1 | 2/2016 | Shimizu et al. |

FOREIGN PATENT DOCUMENTS

| | | | |
|---|---|---|---|
| JP | 2012-241803 | A | 12/2012 |
| JP | 2013-231464 | A | 11/2013 |
| JP | 2015-48899 | A | 3/2015 |
| KR | 10-2012-0137343 | A | 12/2012 |
| WO | WO 2014/168058 | A1 | 10/2014 |

OTHER PUBLICATIONS

Japanese-language Written Opinion (PCT/ISA/237) issued in PCT Application No. PCT/JP2015/060654 dated Jun. 20, 2015 (4 pages).

FIG. 4

| | THIRD HYDRAULIC PUMP | SECOND HYDRAULIC PUMP | FIRST HYDRAULIC PUMP |
|---|---|---|---|
| BOOM | P3(2) | P1 | P3(1) |
| ARM | P2(1) | P2(3) | P2(2) |
| BUCKET | – | – | P1 |
| SWING | P1 | – | – |

FIG. 5

(a) BOOM-SWING COMBINED CONTROL

| | THIRD HYDRAULIC PUMP | SECOND HYDRAULIC PUMP | FIRST HYDRAULIC PUMP |
|---|---|---|---|
| BOOM | P3(2) | [P1] | P3(1) |
| ARM | P2(1) | P2(3) | P2(2) |
| BUCKET | – | – | P1 |
| SWING | [P1] | – | – |

(b) BOOM-ARM COMBINED CONTROL

| | THIRD HYDRAULIC PUMP | SECOND HYDRAULIC PUMP | FIRST HYDRAULIC PUMP |
|---|---|---|---|
| BOOM | P3(2) | [P1] | P3(1) |
| ARM | [P2(1)] | P2(3) | [P2(2)] |
| BUCKET | – | – | P1 |
| SWING | P1 | – | – |

(c) BOOM-ARM-BUCKET COMBINED CONTROL

| | THIRD HYDRAULIC PUMP | SECOND HYDRAULIC PUMP | FIRST HYDRAULIC PUMP |
|---|---|---|---|
| BOOM | P3(2) | [P1] | P3(1) |
| ARM | [P2(1)] | P2(3) | P2(2) |
| BUCKET | – | – | [P1] |
| SWING | P1 | – | – |

(d) BOOM-ARM-BUCKET-SWING COMBINED CONTROL

| | THIRD HYDRAULIC PUMP | SECOND HYDRAULIC PUMP | FIRST HYDRAULIC PUMP |
|---|---|---|---|
| BOOM | P3(2) | [P1] | P3(1) |
| ARM | {P2(1)} | P2(3) | P2(2) |
| BUCKET | – | – | [P1] |
| SWING | {P1} | – | – |

HYDRAULIC CONTROL SYSTEM FOR WORKING MACHINE

TECHNICAL FIELD

The present invention relates to a hydraulic control system for a working machine, such as a hydraulic excavator and the like, equipped with a plurality of actuators and being capable of performing combined control of the plurality of actuators.

BACKGROUND ART

As hydraulic control systems for a working machine, such as construction machinery, typified by a hydraulic excavator and the like, a hydraulic control system is known which is configured to have a plurality of hydraulic pumps and a plurality of actuators connected to each other via a plurality of directional control valves (valve commonly called control valves and having the function of changing the direction of hydraulic oil flow and the function of narrowing the flow passage). For such hydraulic control systems, various techniques with which operability is improved for operators are developed, and examples of this kind of art include one described in Patent Literature 1. In Patent Literature 1, a plurality of pumps and a plurality of actuators are connected via a plurality of parallel-connected directional control valves. According to the technique described in Patent Literature 1, during normal operation of a hydraulic excavator, typified by excavation work and the like, in particular, the operability can be ensured while higher fuel efficiency can be realized.

CITATION LIST

Patent Literature

Patent Literature 1: Japanese Unexamined Patent Application Publication No. 2012-241803

SUMMARY OF INVENTION

Technical Problem

According to the technique described in Patent Literature 1, it is possible to enhance the operability of a hydraulic excavator, the performance for fuel efficiency and the like, particularly, in normal operation such as typified by excavation work. However, the invention described in Patent Literature 1 depends on the configuration itself of hydraulic circuitry and/or hardware such as hydraulic equipment and/or the like, as a result of which it is difficult to provide satisfied performance for, for example, a combination of actuators to be operated, that is, for various combined operations, and further, since improvements aimed at further enhancing the performance involves making modifications to the hardware, such improvements are not easy in terms of time and costs. Further, there is a necessity to make modifications to hardware in order to maintain or enhance the performance for different works, such as, e.g., excavation work and leveling work, to be ready for an attachment (e.g., a grapple or the like) used in special application, and the like.

The present invention has been made in light of the above circumstances in the related art, and an object of the present invention is to provide a hydraulic control system for a working machine, the hydraulic control system having ability to meet performance requirements related to operability, fuel efficiency and the like even in various combined operations, and also the hydraulic control system having versatility to be easily adaptable for improvements to enhance the performance, variously different works or use of a special attachments without modifications to hardware.

Solution to Problem

To achieve this object, the present invention provides a hydraulic control system for a working machine which includes: a prime mover; a plurality of hydraulic pumps driven by the prime mover; a plurality of directional control valves, more than one of which is connected in parallel to each of the plurality of hydraulic pumps, the directional control valves directing hydraulic oil discharged from the hydraulic pumps to a predetermined actuator of a plurality of actuators; the plurality of actuators that are driven with hydraulic oil which is directed by the plurality of directional control valves after being discharged from the plurality of hydraulic pumps; a plurality of working members that are each operated by the plurality of actuators; a plurality of operating devices that are manipulated by an operator to drive the plurality of actuators, and output operation signals representing manipulated variables thus obtained in the manipulation; and a control device that receives the operation signals from the plurality of operating devices, then calculates pump control signals for the plurality of hydraulic pumps and valve drive signals for the plurality of directional control valves on the basis of a plurality of operation signals, and then outputs the pump control signals to the plurality of hydraulic pumps, and also outputs the valve drive signals to the plurality of directional control valves. The control device has a storage unit storing, as a map, a precedence order for supplies of hydraulic oil discharged by the plurality of hydraulic pumps to the plurality of actuators. The control device makes a comparison of the operation signals received from the plurality of operating devices and the map stored in the storage unit to determine which actuator of the plurality of actuators the hydraulic oil discharged by each of the plurality of hydraulic pumps is supplied to.

In the present invention configured as described above, the operation signals received from the operating devices are checked against the map stored in the storage unit of the control device, as a result of which a combination of a hydraulic pump from which hydraulic oil is supplied and an actuator to be driven with the hydraulic oil is determined. Based on this combination, a pump control signal for each hydraulic pump and a valve drive signal for each directional control valve are calculated. By the signals, each hydraulic pump and each directional control valve are driven to operate the corresponding actuator.

Here, in the map, a precedence order of the actuators to which the hydraulic oil is to be supplied from each hydraulic pump can be set as desired by considering a maximum discharge pressure and/or maximum discharge rate of each of the hydraulic pumps used, a required flow rate based on a shape and/or a maximum operation speed of each actuator and/or the like, and/or the like.

Because a combination of an actuator and a hydraulic pump selected from a map is selected in response to an operation signal, the performance related to operability, fuel efficiency and the like can be ensured irrespective of operation of a single actuator or combined operation of a plurality of actuators. Further, even if the specifications of hydraulic equipment such as a hydraulic pump, a directional control valve, an actuator and the like are changed, or even if design changes are made to a travel base, a revolving upperstructure, a front working member such as a boom, an arm and/or the like which form a working machine, and/or the like, or even if main work details are changed, or even if a special attachment is used, the performance can be maintained or enhanced only by modifying the setting of the map.

Advantageous Effects of Invention

The hydraulic control system for a working machine according to the present invention can meet performance related to operability, fuel efficiency and the like even when being operated in various combined operations, and also can be easily adaptable for improvements to enhance the performance, variously different works or use of a special attachments without modifications to hardware.

BRIEF DESCRIPTION OF DRAWINGS

FIG. 4 shows a table illustrating an example of connection maps stored in a storage unit of the hydraulic control system according to the first embodiment.

FIG. 5 shows tables illustrating connection maps stored in a storage unit of the hydraulic control system according to the first embodiment, the connection maps for the boom-swing combined control, the boom-arm combined control, the boom-arm-bucket combined operation and the boom-arm-bucket-swing combined operation.

DESCRIPTION OF EMBODIMENTS

Embodiments of a hydraulic control device for a working machine according to the present invention will now be described with reference to the drawings.

First Embodiment

Figure 1:
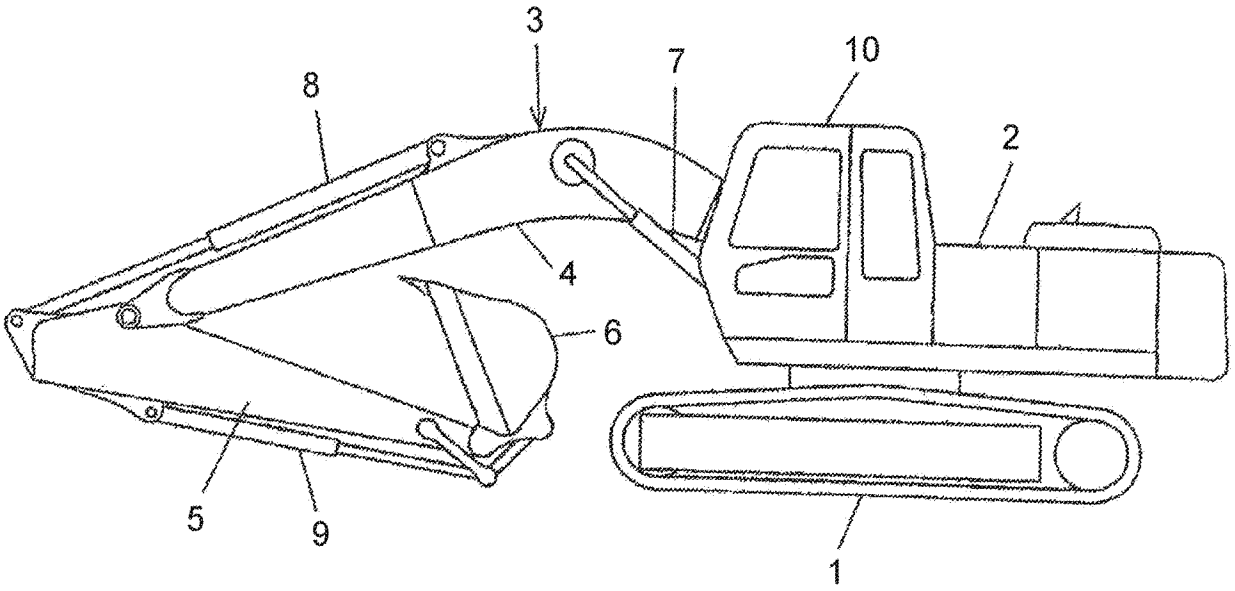
FIG. 1 is a side view of a hydraulic excavator shown as an example of a working machine to which a first embodiment of a hydraulic control system according to the present invention is applied.

A working machine in which a hydraulic control device according to a first embodiment of the present invention is installed is, for example, a hydraulic excavator. FIG. 1 is a side view showing a hydraulic excavator taken as an example of the working machine in which the hydraulic control device according to the first embodiment of the present invention is installed. The hydraulic excavator shown in FIG. 1 includes a travel base 1, a revolving upperstructure 2 mounted on the travel base 1, and a front working mechanism attached to the revolving upperstructure 2, that is, a working apparatus 3. The working apparatus 3 has a boom 4, an arm 5 and a bucket 6, the boom 4 being vertically pivotally mounted to the revolving upperstructure 2, the arm 5 being vertically pivotally mounted to the boom 4, the bucket 6 being vertically pivotally mounted to the arm 5. The working apparatus 3 also has a boom cylinder 7 for actuating the boom 4, an arm cylinder 8 for actuating the arm 5 and a bucket cylinder 9 for actuating the bucket 6. The revolving upperstructure 2 is also configured to be swung relative to the travel base 1 by a swing motor 50 shown in FIG. 2. Further, a cab 10 is provided in the front of the revolving upperstructure 2.

Figure 2:
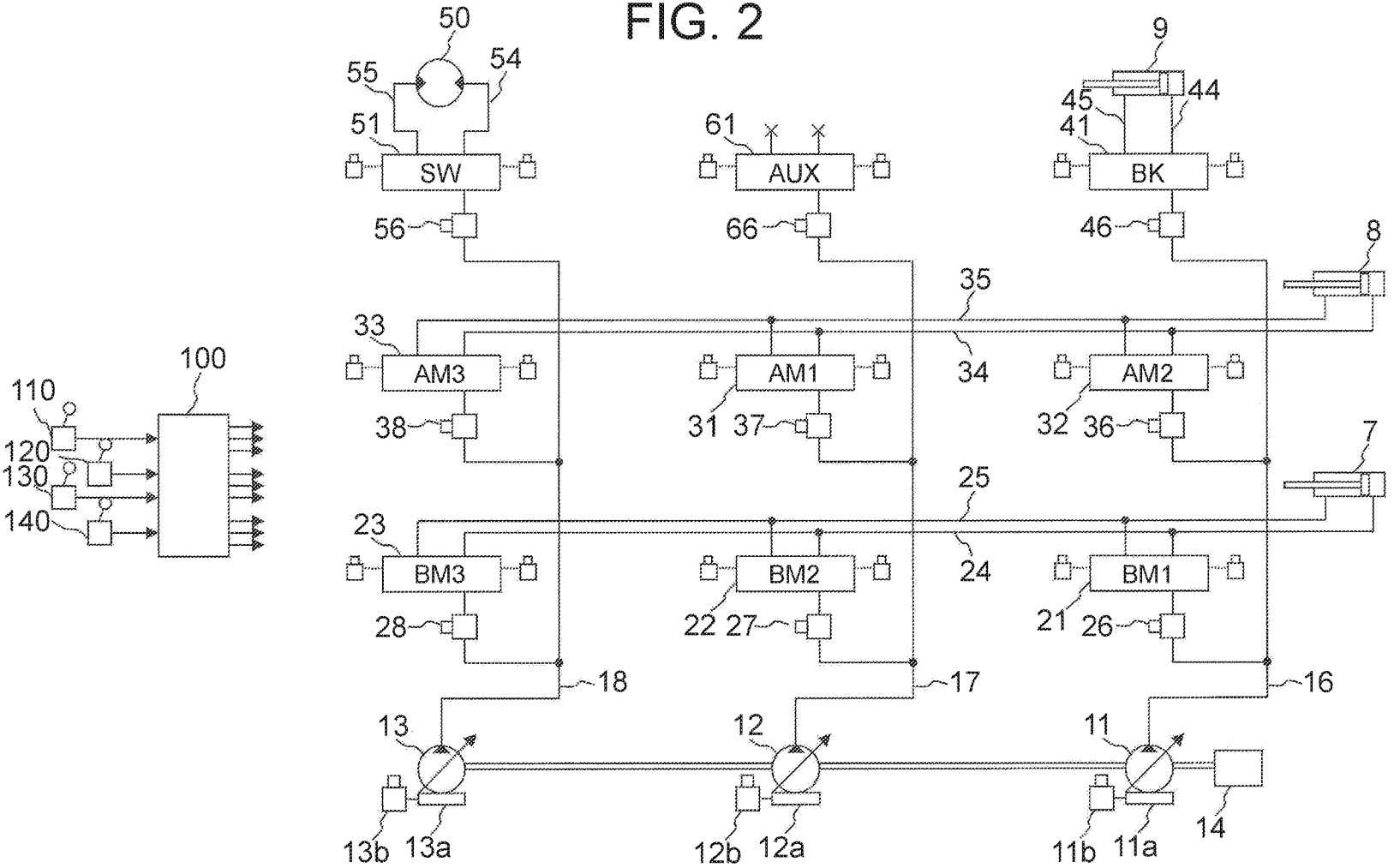
FIG. 2 is an electric hydraulic circuit diagram illustrating the first embodiment of the present invention.

A hydraulic control system according to the first embodiment, which is installed in the hydraulic excavator shown in FIG. 1, has, as illustrated in FIG. 2, a first hydraulic pump 11, a second hydraulic pump 12 and a third hydraulic pump 13 which are driven by a prime mover, e.g., an engine 14. The hydraulic control system also has a first hydraulic pump regulator 11*a* that controls a tilting angle (discharge displacement) of the first hydraulic pump 11, a second hydraulic pump regulator 12*a* that controls a tilting angle of the second hydraulic pump 12, and a third hydraulic pump regulator 13*a* that controls a tilting angle of the third hydraulic pump 13. The hydraulic control system also has a first hydraulic pump control valve 11*b* that outputs a control pressure to the first hydraulic pump regulator 11*a* such that the target tilting angle is reached, a second hydraulic pump control valve 12*b* that outputs a control pressure to the second hydraulic pump hydraulic regulator 12*a*, and a third hydraulic pump control valve 13*b* that outputs a control pressure to the third hydraulic pump regulator 13*a*.

In the first embodiment, further, a first boom directional control valve 21, a second arm directional control valve 32 and a bucket directional control valve 41 are each connected in parallel to the first hydraulic pump 11 through a pipe 16, and a first boom pressure control valve 26, a second arm pressure control valve 36 and a bucket pressure control valve 46 are connected to the upstream sides of the respective directional control valves.

Also, a second boom directional control valve 22, a first arm directional control valve 31 and an auxiliary directional control valve 61 are each connected in parallel to the second hydraulic pump 12 through a pipe 17, and a second boom pressure control valve 27, a first arm pressure control valve 37 and an auxiliary pressure control valve 66 are connected to the upstream sides of the respective directional control valves.

Also, a third boom directional control valve 23, a third arm directional control valve 33 and a swing motor directional control valve 51 are each connected in parallel to the third hydraulic pump 13 through a pipe 18, and a third boom pressure control valve 28, a third arm pressure control valve 38 and a swing motor pressure control valve 56 are connected to the upstream sides of the respective directional control valves.

The first embodiment further includes a boom operating device 110 for operation of the boom cylinder 7, an arm operating device 120 for operation of the arm cylinder 8, a bucket operating device 130 for operation of the bucket cylinder 9, a swing operating device 140 for operation of the swing motor 50 and a controller 100 into which each of signals of the control devices is input.

Further, the first boom directional control valve 21, the second boom directional control valve 22 and the third boom directional control valve 23 are connected to the boom cylinder 7 through pipes 24 and 25. The first arm directional control valve 31, the second arm directional control valve 32 and the third arm directional control valve 33 are connected to the arm cylinder 8 through pipes 34 and 35. The swing directional control valve 51 is connected to the swing motor 50 through pipes 54 and 55, and the bucket directional control valve 41 is connected to the bucket cylinder 9 through pipes 44 and 45.

Figure 3:
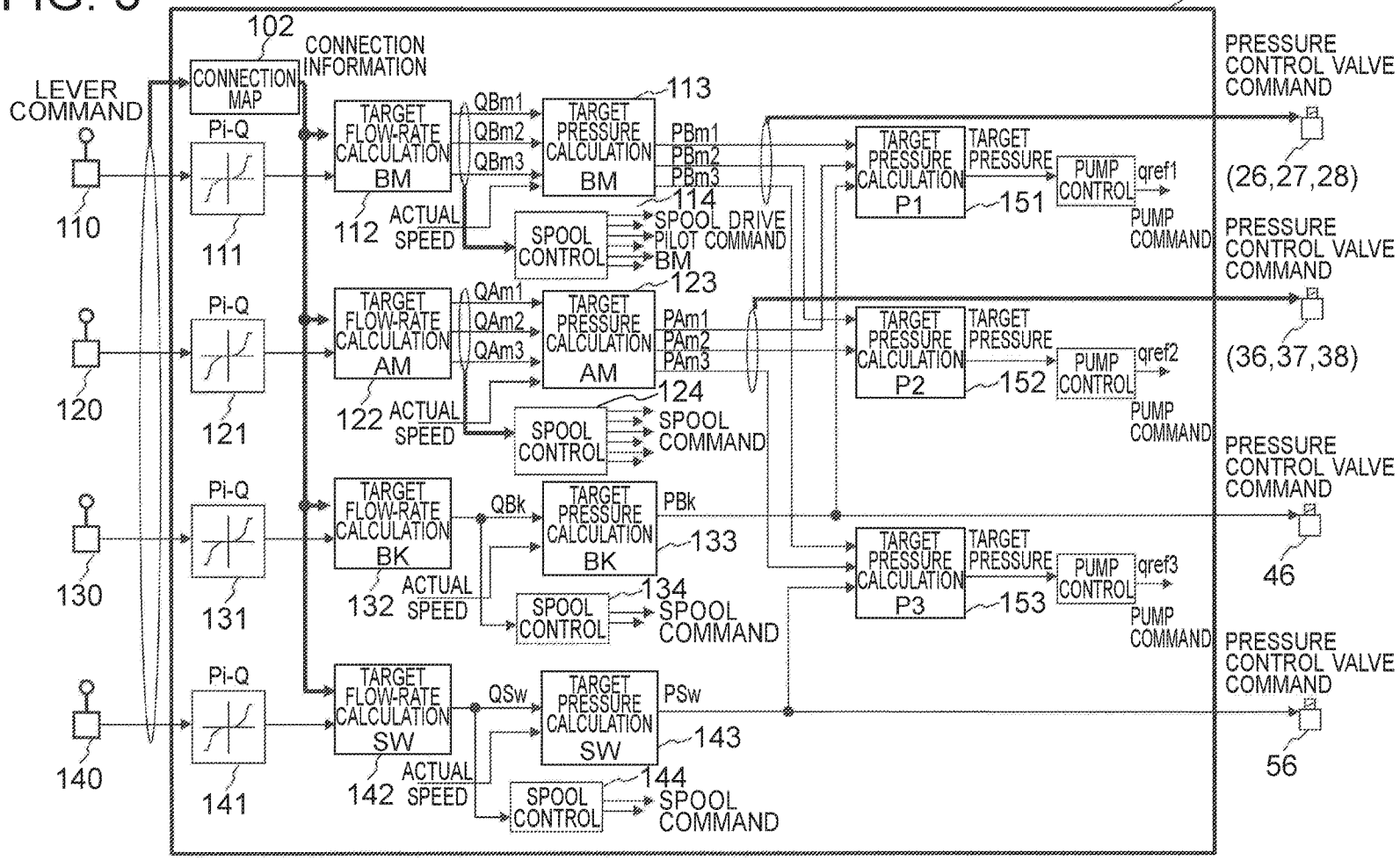
FIG. 3 shows a flow chart illustrating processing procedure in a controller for the operation of the hydraulic control system according to the first embodiment.

As shown in FIG. 3, the controller 100 has a connection map 102 that represents a precedence order set for the connection relationship between each of the actuators of the respective boom cylinder 7, arm cylinder 8, bucket cylinder 9 and swing motor 50, and the first, second and third hydraulic pumps 11, 12 and 13 which supply hydraulic oil to the actuators, and the controller 100 also has a boom required flow-rate calculator 111, an arm required flow-rate calculator 121, a bucket required flow-rate calculator 131, and a swing required flow-rate calculator 141 that calculate required flow rates Q of the boom cylinder 7, arm cylinder 8, bucket cylinder 9 and swing motor 50 on the basis of command signals Pi from the boom operating device 110, arm operating device 120, bucket operating device 130 and swing operating device 140 which are operated by an operator. The controller 100 also has a boom target flow-rate calculator 112, an arm target flow-rate calculator 122, a bucket target flow-rate calculator 132 and a swing target flow-rate calculator 142 that each receive the connection relationship between each actuator 7, 8, 9, 50 and each hydraulic pump 11, 12, 13 based on the connection map 102 as well as receive the required flow rates Q for the respective actuators from the respective required flow-rate calculators 111, 121, 131, 141, so that the target flow-rate calculators 112, 122, 132, 142 calculate target flow rates QBm1, QBm2, QBm3, QAm1, QAm2, QAm3, QBk, QSw to be supplied to the corresponding actuators 7, 8, 9, 50 by the corresponding hydraulic pumps 11, 12, 13. The controller 100 further has a boom target pressure calculator 113, an arm target pressure calculator 123, a bucket target pressure calculator 133 and a swing target pressure calculator 143 that each receive the individual target flow rates QBm1, QBm2, QBm3, QAm1, QAm2, QAm3, QBk, QSw from the corresponding target flow-rate calculators 112, 122, 132, 142 as well as receive the operating speeds of the respective cylinders 7, 8, 9 and the swing speed of the swing motor 50, so that the target pressure calculators 113, 123, 133, 143 calculate target drive pressures of hydraulic oil to be supplied to the respective actuators 7, 8, 9, 50, and then output target drive pressure signals PBm1, PBm2, PBm3, PAm1, PAm2, PAm3, PBk, PSw. In this connection, each of the target drive pressure signals PBm1, PBm2, PBm3, PAm1, PAm2, PAm3, PBk, PSw is output to the corresponding one of the pressure control valves 26, 27, 28, 36, 37, 38, 46, 56 which are installed respectively upstream of the directional control valves 21, 22, 23, 31, 32, 33, 46, 56, in order to control the drive pressure for each actuator 7, 8, 9, 50. The controller 100 also has a boom directional-control-valve control variable calculator (spool control) 114, an arm directional-control-valve control variable calculator 124, a bucket directional-control-valve control variable calculator 134, and a swing directional-control-valve control variable calculator 144 that each receive the target flow rates QBm1, QBm2, QBm3, QAm1, QAm2, QAm3, QBk, QSw from the target flow-rate calculators 112, 122, 132, 142. The control variable calculators 114, 124, 134, 144 calculate the opening areas of the respective directional control valves 21, 22, 23, 31, 32, 33, 46, 56, and then output spool drive signals based on the calculated results. The controller 100 further include a first pump target pressure calculator 151, a second pump target pressure calculator 152 and a third pump target pressure calculator 153 that individually receive the target drive pressures PBm1, PBm2, PBm3, PAm1, PAm2, PAm3, PBk, PSw, and then calculate target discharge pressure P1, P2, P3 from the respective hydraulic pumps 11, 12, 13, and the controller 100 outputs pump command signals qref1, qref2, qref3 corresponding to the respective pump regulators 11*a*, 12*a*, 13*a* to be set to the respective target pressures.

The connection map 102 described above represents a precedence order set for each connection between each actuator 7, 8, 9, 50 and each hydraulic pump 11, 12, 13 on the basis of pre-obtained information such as usage of the hydraulic excavator, the frequency of operation, and/or the like. FIG. 4 illustrates an example connection map of the hydraulic pumps and the actuators. The first column represents types of actuators, while the first row represents types of hydraulic pumps. In the example connection map illustrated in FIG. 4, the map represents which of the boom cylinder 7, the arm cylinder 8, the bucket cylinder 9 and the swing motor 50 is supplied with hydraulic oil discharged from each of the first hydraulic pump 11, the hydraulic pump 12 and the third hydraulic pump 13, in which reference signs P1 to P3 shown in the table denote priorities of the actuators for the hydraulic pumps, where the lower the digit of P1 to P3, the higher the priority is shown. For example, in the connection map 102 shown in FIG. 4, in the precedence order of the actuators to be supplied with the hydraulic oil discharged from the third hydraulic pump 13, the highest priority is given to the swing motor 50, the second highest priority is given to the arm cylinder 8 and then the third highest priority is given to the boom cylinder 7.

Further, reference signs (1) to (3) provided in the table denote a precedence order used when the priorities indicated by P1 to P3 are the same, that is, denote a precedence order of the hydraulic pumps for a specific actuator (hereinafter referred to as a "second precedence order"). For example, in FIG. 4, for the arm cylinder 8, all the first to third hydraulic pumps 11-13 are given the second highest priority, i.e., "P2". However, for actual driving of the arm cylinder 8, the second precedence order is designed to assign the highest priority to the third hydraulic pump 13 indicated with P2(1), then the second highest priority to the first hydraulic pump 11 indicated with P2(2), and then the third highest priority to the second hydraulic pump 12 indicated with P2(3). Thus, when the arm cylinder 8 is driven, the arm cylinder 8 is assigned the third hydraulic pump 13, the first hydraulic pump 11 and then the second hydraulic pump 12 in this order.

The following is the description of computing processing and operation of each of equipment according to the first embodiment as configured in this manner.

Boom-Swing Combined Control

Initially, combined control for the boom and swing is described as an example.

Upon an operator operating the boom operating device 110 and the swing operating device 140 shown in FIG. 3, the controller 100 causes the boom required flow-rate calculator 111 and the swing required flow-rate calculator 141 to calculate, based on the incoming manipulated-variable signals Pi, required flow rates Q required for operation of the boom cylinder 7 and the swing motor 50.

Further, in the boom-swing combined control, as shown by square brackets in a connection map(a) in FIG. 5, the second hydraulic pump 12 is selected for the boom cylinder 7 and the third hydraulic pump 13 is selected for the swing motor 50. In FIG. 5(*a*), "P3(1)" is entered into the cell of the first pump 11 in the row of the boom cylinder 7, and "P3(2)" is entered into the cell of the third hydraulic pump 13 in the same row, which mean that, if there is an insufficient supply flow rate from the second hydraulic pump 12 to the boom cylinder 7, the first hydraulic pump 11 and then third hydraulic pump 13 are selected in this order in addition to the second hydraulic pump 12. Note that, for the purpose of simplicity, the example is described assuming that the flow rate from the second pump 12 is a sufficient flow rate required to be supplied to the boom cylinder 7. Based on the connection information and the operation signal Pi as described above, the boom target flow-rate calculator 112 and the swing target flow-rate calculator 142, which are shown in FIG. 3, calculate a target flow rate QBm2 to be supplied from the second hydraulic pump 12 to the boom cylinder 7 and a target flow rate QSw to be supplied from the third hydraulic pump 13 to the swing motor 50.

Then, from the target flow rate QBm2 for the boom cylinder 7 and an actual speed, i.e., a real speed, of the boom cylinder 7 detected by a not-shown speed sensor, the boom target pressure calculator 113 shown in FIG. 3 calculates a target drive pressure PBm2 of the boom cylinder 7. Then, based on the target drive pressure PBm2, the second pump target pressure calculator 152 calculates a target discharge pressure P2 of the second hydraulic pump 12, and then a pump command signal qref2 is output to the pump regulator 12*a* for the second hydraulic pump 12 so that the target discharge pressure P2 is reached, resulting in the tilting angle, i.e., the discharge flow rate of the second hydraulic pump 12 being controlled in response to the command signal qref2.

Also, from the target flow rate QSw for the swing motor 50 and an actual speed, i.e., a real speed, of the swing motor 50 detected by a not-shown speed sensor, the swing target pressure calculator 143 shown in FIG. 3 calculates a target drive pressure PSw of the swing motor 50. Then, based on the target drive pressure PSw, the third pump target pressure calculator 153 calculates a target discharge pressure P3 of the third hydraulic pump 13, and then a pump command signal qref3 is output to the pump regulator 13*a* for the third hydraulic pump 13 so that the target discharge pressure P3 is reached, resulting in the tilting angle, i.e., the discharge rate of the third hydraulic pump 13 being controlled in response to the command signal qref3.

Meanwhile, the second boom pressure control valve 27 and the swing motor pressure control valve 56 are controlled based on the target drive pressures PBm2, PSw calculated by the boom target pressure calculator 113 and the swing target pressure calculator 143. Further, based on the target flow rates QBm2, QSw which have been calculated by the boom target flow-rate calculator 112 and the swing target flow-rate calculator 142, the boom directional-control-valve control variable calculator 114 and the swing directional-control-valve control variable calculator 144 calculate opening areas of the second boom directional control valve 22 and the swing directional control valve 51, and then spool drive signals based on this calculation are output to the second boom directional control valve 22 and the swing directional control valve 51 to control the action of each spool so that the targeted opening area can be reached.

In this manner, in the boom-swing combined control, the second hydraulic pump 12 is used to drive the boom cylinder 7 and the third hydraulic pump 13 is used to drive the swing motor 50, in which the second boom directional control valve 22 is actuated in response to the drive signal from the spool drive control element 114 to supply hydraulic oil to the boom cylinder 7, and also the swing directional control valve 51 is actuated in response to the drive signal from the spool drive control element 144 to supply hydraulic oil to the swing motor 50. Incidentally, the other directional control valves are held in their spool neutral positions.

As described above, in the operation of a combination of the swinging operation and the boom raising operation, the amounts of hydraulic oil corresponding to the operation signals Pi from the boom operating device 110 and the swing swinging device 140 are discharged from the second hydraulic pump 12 and the third hydraulic pump 13. During the supply of the discharged hydraulic oil from the second hydraulic pump 12 and the third hydraulic pump 13 to the boom cylinder 7 and the swing motor 50, there is no loss produced by oil returning to a tank without being supplied in effect to the actuator for flow-rate control, that is, produced by surplus oil (bleed-off loss) and/or no loss caused by a pressure drop produced at a flow dividing valve and/or the like when the hydraulic oil is supplied from a single hydraulic pump to a plurality of actuators, and the like (meter-in loss), enabling the driving of the hydraulic excavator with a high degree of energy transfer efficiency.

Boom-Arm Combined Control

Next, combined control for the boom and the arm is described.

Upon an operator operating the boom operating device 110 and the arm operating device 120 shown in FIG. 3, the controller 100 receives operation signals Pi as commands to operate the boom and the arm. In the controller 100, the boom required flow-rate calculator 111 and the arm required flow-rate calculator 121 calculate, based on the incoming operation signals Pi and the information stored in the connection map 102, flow rates required for the boom cylinder 7 and the arm cylinder 8, respectively.

In the boom-arm combined control, as illustrated in the connection map(b) described in FIG. 5, the second hydraulic pump 12 is used to operate the boom 7 and the first hydraulic pump 11 and the third hydraulic pump 13 are used to operate the arm 8. It is noted that, depending upon magnitude of the operation signal Pi, a situation may arise where the hydraulic oil for the boom cylinder 7 must be supplied additionally from the first hydraulic pump 11 and the third hydraulic pump 13 or a situation may arise where the hydraulic oil for the arm cylinder 8 must be supplied additionally from the second hydraulic pump 12. However, for the purpose of simplicity, the description is given on the assumption of the situation where the boom cylinder 7 is supplied with hydraulic oil from a single hydraulic pump and the arm cylinder 8 is supplied with hydraulic oil from two hydraulic pumps.

Based on the connection information and the required flow rates Q, the controller 100 causes the boom target flow-rate calculator 112 and the arm target flow-rate calculator 122, which are shown in FIG. 3, to calculate a target flow rate QBm2 to be supplied from the second hydraulic pump 12 to the boom cylinder 7, a target flow rate QAm1 to be supplied from the first hydraulic pump 11 to the arm cylinder 8, and a target flow rate QAm3 to be supplied from the third hydraulic pump 13 to the arm cylinder 8.

Then, from the target flow rate QBm2 for the boom cylinder 7 and an actual speed, i.e., a real speed, of the boom cylinder 7 detected by a not-shown speed sensor, the boom target pressure calculator 113 shown in FIG. 3 calculates a target drive pressure PBm2 of the boom cylinder 7. Then, based on the target drive pressure PBm2, the second pump target discharge pressure calculator 152 calculates a target discharge pressure P2 of the second hydraulic pump 12, and then a pump command signal qref2 is output to the regulator 12*a* for the second hydraulic pump 12 so that the target discharge pressure P2 is reached, resulting in the tilting angle of the second hydraulic pump 12 being controlled.

Also, from the target flow rates QAm1, QAm3 for the arm cylinder 8 and an actual speed, i.e., a real speed, of the arm cylinder 8 detected by a not-shown speed sensor, the arm target pressure calculator 123 shown in FIG. 3 calculates target drive pressures PAm1, PAm3 of the arm cylinder 8. Then, based on the target drive pressures PAm1, PAm3, the first pump target pressure calculator 151 and the third pump target pressure calculator 153 calculate target discharge pressures P1, P3 of the first hydraulic pump 11 and the third hydraulic pump 13, and then pump command signals qref1, qref3 are output to the regulators 11*a*, 13*a* for the respective first and third hydraulic pumps 11 and 13 so that the target discharge pressures P1, P3 are reached, resulting in the tilting angles of the first hydraulic pump 11 and the third hydraulic pump 13 being controlled.

Meanwhile, the second boom pressure control valve 27, the second arm pressure control valve 36 and the third arm pressure control valve 38 are controlled based on the target drive pressures PBm2, PAm1, PAm3 thus calculated by the boom target pressure calculator 113 and the arm target pressure calculator 123. Further, based on the target flow rates QBm2, QAm1, QAm3 thus calculated by the boom target flow-rate calculator 112 and the arm target flow-rate calculator 122, the directional-control-valve control variable calculators 114, 124 calculate opening areas which are targets of the second boom directional control valve 22, the first arm directional control valve 31 and the third arm directional control valve 33, and spool drive signals based on this calculation are output.

As a result, in the boom-arm combined operation, the amounts of hydraulic oil corresponding to the operation signals Pi from the boom operating device 110 and the arm operating device 120 are supplied from the first hydraulic pump 11, the second hydraulic pump 12 and the third hydraulic pump 13 to the boom cylinder 7 and the arm cylinder 8. During this supply, there is no loss produced by oil returning to a tank without being supplied in effect to the actuator for flow-rate control, that is, produced by surplus oil (bleed-off loss) and/or no loss produced by flow diversion caused when the hydraulic oil is supplied from a single pump to a plurality of actuators (meter-in loss), enabling the driving of the hydraulic excavator with a high degree of energy transfer efficiency.

Boom-Arm-Bucket Combined Control

Next, combined control for the boom, the arm and the bucket is described.

Upon an operator operating the boom operating device 110, the arm operating device 120 and the bucket operating device 130 shown in FIG. 3, the controller 100 receives operation signals Pi as boom operation, arm operation and bucket operation, and in the controller 100, based on the incoming manipulated variable signals Pi and the information stored in the connection map 102, the boom required flow-rate calculator 111, the arm required flow-rate calculator 121 and the bucket required flow-rate calculator 131 calculate flow rates Q required for the boom cylinder 7, the arm cylinder 8 and the bucket cylinder 9.

In the boom-arm-bucket combined control, as illustrated in the connection map(c) illustrated in FIG. 5, the second hydraulic pump 12 is used to drive the boom cylinder 7 and the first hydraulic pump 11 is used to drive the bucket cylinder 9. Also, the third hydraulic pump 13 is used on a priority basis to drive the arm cylinder 8, and, in the event of flow rate shortage, the first hydraulic pump 11 used to drive the bucket cylinder 9 is used concurrently, but the explanation is made about use of the third hydraulic pump 13 alone. Based on the connection information and the required flow rates Q, the controller 100 causes the boom target flow-rate calculator 112, the arm target flow-rate calculator 122 and the bucket target flow-rate calculator 132 to calculate a target flow rate QBm2 to be supplied from the second hydraulic pump 12 to the boom cylinder 7, a target flow rate QAm3 to be supplied from the third hydraulic pump 13 to the arm cylinder 8, and a target flow rate QBk to be supplied from the first hydraulic pump 11 to the bucket cylinder 9.

Then, from the target flow rate QBm2 for the boom cylinder 7 and an actual speed, i.e., a real speed, of the boom cylinder 7 detected by a not-shown speed sensor, the boom target pressure calculator 113 shown in FIG. 3 calculates a target drive pressure PBm2 of the boom cylinder 7. Then, based on the target drive pressure PBm2, the second pump target pressure calculator 152 calculates a target discharge pressure P2 of the second hydraulic pump 12, and then a pump command signal qref2 is output to the regulator 12*a* for the second hydraulic pump 12 so that the target discharge pressure P2 is reached, resulting in the tilting angle of the second hydraulic pump 12 being controlled.

Also, from the target flow rate QAm3 for the arm cylinder 8 and an actual speed, i.e., a real speed, of the arm cylinder 8 detected by a not-shown speed sensor, the arm target pressure calculator 123 shown in FIG. 3 calculates a target drive pressure PAm3 of the arm cylinder 8. Then, based on the target drive pressure PAm3, the third pump target pressure calculator 153 calculates a target discharge pressure P3 of the third hydraulic pump 13, and then a pump command signal qref3 is output to the regulator 13*a* for the third hydraulic pump 13 so that the target discharge pressure P3 is reached, resulting in the tilting angle of the third hydraulic pump 13 being controlled.

Also, from the target flow rate QBk for the bucket cylinder 9 and an actual speed, i.e., a real speed, of the bucket cylinder 9 detected by a not-shown speed sensor, the bucket target pressure calculator 133 shown in FIG. 3 calculates a target drive pressure PBk of the bucket cylinder 9. Then, based on the target drive pressure PBk, the first pump target pressure calculator 151 calculates a target discharge pressure P1 of the first hydraulic pump 11, and then a pump command signal qref1 is output to the regulator 11*a* for the first hydraulic pump 11 so that the target discharge pressure P1 is reached, resulting in the tilting angle of the first hydraulic pump 11 being controlled.

Meanwhile, the second boom pressure control valve 27, the third arm pressure control valve 38 and the bucket pressure control valve 46 are controlled based on the target drive pressures PBm2, PAm3, PBk thus calculated by the boom target pressure calculator 113, the arm target pressure calculator 123 and the bucket target pressure calculator 133. Further, based on the target flow rates QBm2, QAm3, QBk thus calculated by the boom target flow-rate calculator 112, the arm target flow-rate calculator 122 and the bucket target flow-rate calculator 132, the boom directional-control-valve control variable calculator 114, the arm directional-control-valve control variable calculator 124 and the bucket directional-control-valve control variable calculator 134 calculate opening areas acting as targets for the second boom directional control valve 22, the third arm directional control valve 33 and the bucket directional control valve 41, and then spool drive signals are output to the second boom directional control valve 22, the third arm directional control valve 33 and the bucket directional control valve 41 to control them so that the targeted opening areas can be reached.

As described above, in the boom, arm and bucket combined operation, the hydraulic oil corresponding to the operation signals Pi from the respective operating devices 110, 120, 130 is discharged from the first hydraulic pump 11, the second hydraulic pump 12 and the third hydraulic pump 13. While the discharged hydraulic oil is supplied to each of the bucket cylinder 9, the boom cylinder 7 and the arm cylinder 8, there is no loss produced by oil returning to a tank without being supplied in effect to the actuator for flow-rate control, that is, produced by surplus oil (bleed-off loss) and/or no loss produced by flow diversion of the hydraulic oil caused when the hydraulic oil is supplied from a single pump to a plurality of actuators (meter-in loss), enabling the driving of the hydraulic excavator with a high degree of energy transfer efficiency.

Boom-Arm-Bucket-Swing Combined Control

Next, combined control for the boom, the arm, the bucket and the swinging is described.

Upon an operator operating the boom operating device 110, the arm operating device 120, the bucket operating device 130 and the swing operating device 140, the controller 100 receives operation signals Pi as commands to operate the boom, arm, bucket and swing.

In the controller 100, based on the incoming manipulated variable signals Pi and the information stored in the connection map 102, the boom required flow-rate calculator 111, the arm required flow-rate calculator 121, the bucket required flow-rate calculator 131 and the swing required flow-rate calculator 141 calculate required flow rates Q for the boom cylinder 7, the arm cylinder 8, the bucket cylinder 9 and the swing motor 50.

In the boom-arm-bucket-swing combined control, as illustrated in the connection map(d) illustrated in FIG. 5, the second hydraulic pump 12 is used to drive the boom, the third hydraulic pump 13 is used to drive the arm, the first hydraulic pump 11 is used to drive the bucket, and the third hydraulic pump 13 is used to drive swing. It is noted that, if the flow rate discharged from the second hydraulic pump 12 is insufficient for driving the boom cylinder 7, the first hydraulic pump 11 is selected in addition to the second hydraulic pump 12, and further, if the flow rate is still insufficient, the third hydraulic pump 13 is additionally selected. Also, if the flow rate from the third hydraulic pump 13 is insufficient for driving the arm cylinder 8, the first hydraulic pump 11 and then the second hydraulic pump 12 are selected in this order in addition to the third hydraulic pump 13. Note that the description is given of the case where the second hydraulic pump 12 alone can provide a sufficient flow rate for driving the boom cylinder 7, and the third hydraulic pump 13 alone can provide a sufficient flow rate for driving the arm cylinder 8.

Based on the connection information and the required flow rates Q, the controller 100 causes the boom target flow-rate calculator 112, the arm target flow-rate calculator 122, the bucket target flow-rate calculator 132 and the swing target flow-rate calculator 142 to calculate a flow rate QBm2 to be supplied from the second hydraulic pump 12 to the boom cylinder 7, a flow rate QAm3 to be supplied from the third hydraulic pump 13 to the arm cylinder 8, a flow rate QBk to be supplied from the first hydraulic pump 11 to the bucket cylinder 9 and a flow rate QSw to be supplied from the third hydraulic pump 13 to the swing motor 50.

Then, from the target flow rate QBm2 for the boom cylinder 7 and an actual speed, i.e., a real speed, of the boom cylinder 7 detected by a not-shown speed sensor, the boom target pressure calculator 113 shown in FIG. 3 calculates a target drive pressure PBm2 of the boom cylinder 7. Then, based on the target drive pressure PBm2, the second pump target pressure calculator 152 calculates a target discharge pressure P2 of the second hydraulic pump 12, and then a pump command signal qref2 is output to the regulator 12*a* for the second hydraulic pump 12 so that the target discharge pressure P2 is reached, resulting in the tilting angle of the second hydraulic pump 12 being controlled.

Also, from the target flow rates QAm3, QSw for the arm cylinder 8 and the swing motor 50 as well as from actual speeds, i.e., real speeds, of the arm cylinder 8 and the swing motor 50 which are detected by not-shown speed sensors, the arm target pressure calculator 123 and the swing target pressure calculator 143, which are shown in FIG. 3, calculate respectively a target drive pressure PAm3 of the arm cylinder 8 and a target drive pressure PSw of the swing motor 50. Then, based on the target drive pressures PAm3, PSw, the third pump target pressure calculator 153 calculates a target discharge pressure P3 of the third hydraulic pump 13, and then a pump command signal qref3 is output to the regulator 13*a* for the third hydraulic pump 13 so that the target discharge pressure P3 is reached, resulting in the tilting angle of the third hydraulic pump 13 being controlled.

Further, from the target flow rate QBk for the bucket cylinder 9 and an actual speed, i.e., a real speed, of the bucket cylinder 9 detected by a not-shown speed sensor, the bucket target pressure calculator 133 shown in FIG. 3 calculates a target drive pressure PBk of the bucket cylinder 9. Then, based on the target drive pressure PBk, the first pump target pressure calculator 151 calculates a target discharge pressure P1 of the first hydraulic pump 11, and then a pump command signal qref1 is output to the regulator 11*a* for the first hydraulic pump 11 so that the target discharge pressure P1 is reached, resulting in the tilting angle of the first hydraulic pump 11 being controlled.

Meanwhile, the second boom pressure control valve 27, the third arm pressure control valve 38, the bucket pressure control valve 46 and the swing motor pressure control valve 56 are controlled based on the target drive pressures PBm2, PAm3, PBk, PSw which have been calculated by the boom target pressure calculator 113, the arm target pressure calculator 123, the bucket target pressure calculator 133 and the swing target pressure calculator 143.

Further, based on the target flow rates QBm2, QAm3, QBk, QSw which have been calculated by the boom target flow-rate calculator 112, the arm target flow-rate calculator 122, the bucket target flow-rate calculator 132 and the swing target flow-rate calculator 142, the boom directional-control-valve control variable calculator 114, the arm directional-control-valve control variable calculator 124, the bucket directional-control-valve control variable calculator 134 and the swing directional-control-valve control variable calculator 144 calculate opening areas acting as targets for the second boom directional control valve 22, the third arm directional control valve 33, the bucket directional control valve 41 and swing directional control valve 51, and then spool drive signals are output to the second boom directional control valve 22, the third arm directional control valve 33, the bucket directional control valve 41 and the swing directional control valve 51 to control them so that the targeted opening areas can be reached.

In the boom-arm-bucket-swing combined control, here, because the third hydraulic pump 13 is used to drive the swing and to drive the arm, the target flow rates QAm3, QSw, which are respectively supplied from the third hydraulic pump 13 to the arm cylinder 8 and the swing motor 50, are calculated by proportionally dividing the target flow rate of the third hydraulic pump 13 on the basis of the manipulated variable of the arm operating device 120 and the swing operating device 140. When the target discharge pressure P3 of the third hydraulic pump 13 is calculated by the third pump target pressure calculator 153, either the target drive pressure PAm3 calculated by the arm target pressure calculator 123 or the target drive pressure PSw calculated by the swing target pressure calculator 143, whichever is higher, is chosen and determined as the target discharge pressure P3.

As described above, for the boom, arm, bucket and swing combined operation, that is, for driving a larger number of actuators than the number of pumps, the connection relationship between the pumps and the actuators is set, in consideration of the discharge flow rate of each pump and a required supply flow rate for each actuator, such that a specific actuator is intensively supplied with hydraulic oil from a single pump and a plurality of other actuators are supplied with a required flow rate from a single pump. Because of this, while a required amount of hydraulic oil is discharged from the pump and then is supplied to each actuator, there is no loss produced by the hydraulic oil returning to a tank without being supplied in effect to the actuator for flow-rate control, that is, produced by surplus oil (bleed-off loss) and/or no loss produced by flow diversion of the hydraulic oil caused when the hydraulic oil is supplied from a single pump to a plurality of actuators (meter-in loss), enabling the driving of the hydraulic excavator with a high degree of energy transfer efficiency.

Second Embodiment

Figure 6:
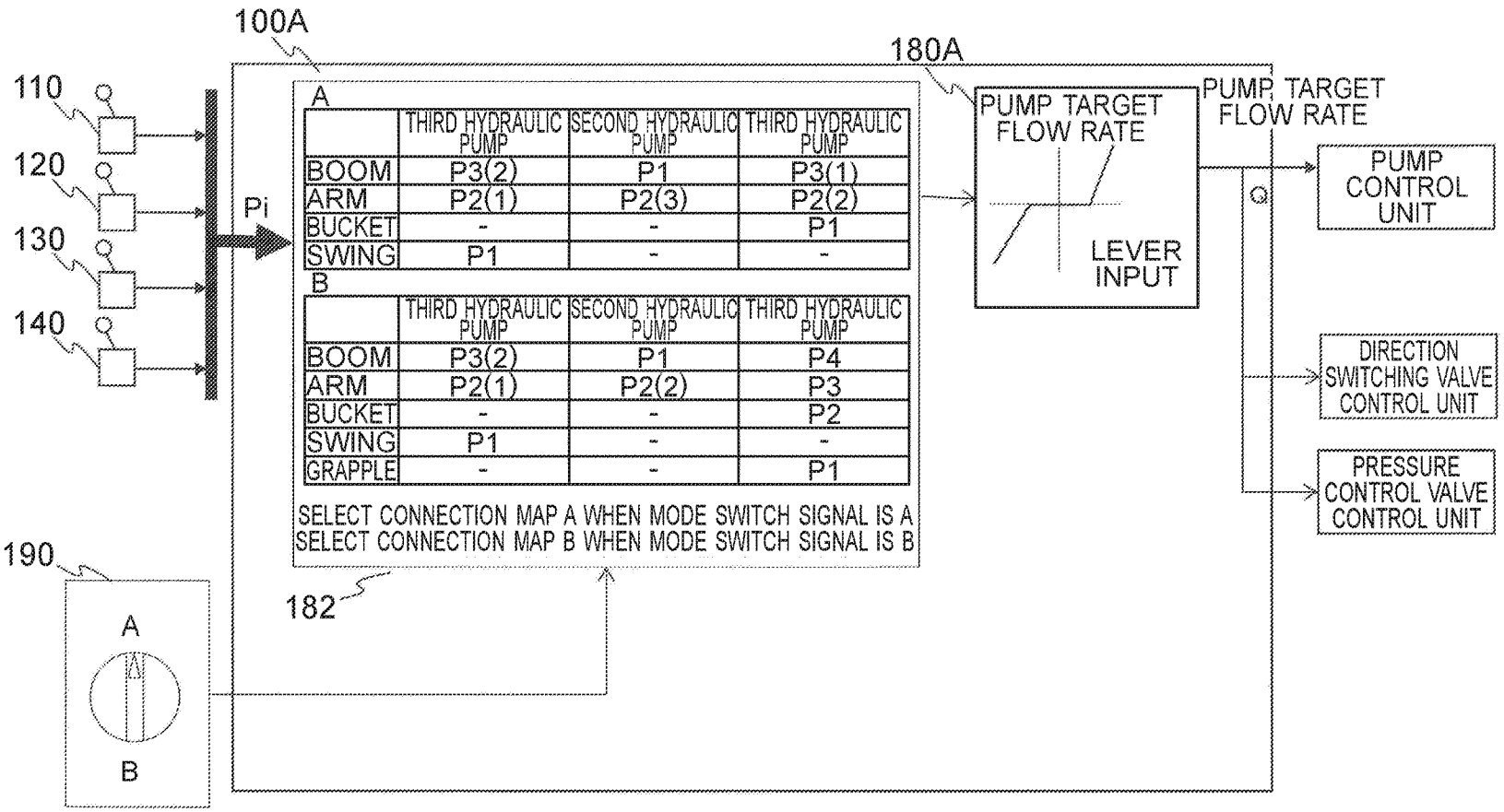
FIG. 6 is a diagram illustrating processing procedure in a controller for the operation of the hydraulic control system according to a second embodiment of the present invention.

FIG. 6 is a diagram illustrating processing procedure in a controller 100A for the operation of a hydraulic control system according to a second embodiment of the present invention. In FIG. 6, a target flow-rate calculation unit 180 corresponds to the boom target flow-rate calculator 112, the arm target flow-rate calculator 122, the bucket target flow-rate calculator 132 and the swing target flow-rate calculator 142 in FIG. 3. A pump control unit corresponds to a group consisting of the target pressure calculators 113, 123, 133, 143 and the pump target pressure calculators 151, 152, 153 shown in FIG. 3. A directional-control-valve control unit 191 corresponds to a group consisting of the directional-control-valve control variable calculators (spool control) 114, 124, 134, 144 shown in FIG. 3. A pressure-control-valve control unit 192 corresponds to the target pressure calculators 113, 123, 133, 143 shown in FIG. 3. The controller 100A configured in the second embodiment according to the present invention receives signals from the boom operating device 110, arm operating device 120, bucket operating device 130 and swing operating device 140, and a mode switch signal from a mode selector 190 that switches the connection relationship of each pump and the actuators.

In the controller 100A, the information on pumps preferentially used for driving each actuator is stored as a connection map 182. Operation signals Pi received from the operating devices and the connection stored in the connection map 182 are input to the target flow-rate calculation unit 180. The target flow-rate calculation unit 180 outputs a pump target flow rate of each hydraulic pumps. Based on the pump target flow rates, the processing described in the above first embodiment is performed in the pump control unit 190, the directional-control-valve control unit 191 and the pressure-control-valve control unit 192 to control, respectively, the tilting angle of each of the hydraulic pump 11, 12, 13, the opening area of each of the corresponding directional control valves, and each of the pressure control valves.

In the second embodiment, the controller 100A receives the mode switch signal from the mode selector 190 and selects a connection relationship of each hydraulic pump and each actuator from A or B shown in the connection map 182. The configuration of other components is the same as that in the first embodiment.

The hydraulic excavator is used for various types of works, so that a flow rate and/or pressure of hydraulic oil required by the actuator are varied from work to work. Further, the attachments are changed for each work. In this case, a required oil flow rate and/or pressure are varied due to variations in weight and/or operation from attachment to attachment, and the like. In the second embodiment of the present invention, as illustrated as "A" and "B" of the connection map 182, connection relationship maps tailored for work details or types of attachments to be used are created, so that a plurality of connection maps can be selectively switched according to work performed by the hydraulic excavator. Accordingly, in addition to the same advantageous effects of the first embodiment, the second embodiment can provide a hydraulic control device for a working machine capable of supplying a target flow rate to each actuator with reliability and offering excellent operability.

For example, in the case of using another attachment, generally called a grapple, instead of the bucket 6 connected to the bucket cylinder 9, unlike the bucket 6, the grapple is structured to make grasping movement and rotating movement. Because of this, another actuator is added as compared with the first embodiment of the present invention. Then, the mode selector 190 is operated to switch the pump-actuator connection relationship from "A" of the connection maps 182 to "B" of the connection maps 182 with the added actuator, as a result of which, even when the attachment is changed to the grapple, the target flow rate corresponding to the operation signal Pi is discharged from each of the hydraulic pumps 11, 12, 13, enabling a reduction of a bleed-off loss and/or a meter-in loss as described above.

In the second embodiment, the mode selector 190 is provided for inputting work details and kinds of attachments, but, for example, the work details and kinds of attachments may be displayed on a control panel to be input to the controller 100A by being selected on a so-called touch panel.

Third Embodiment

Figure 7:
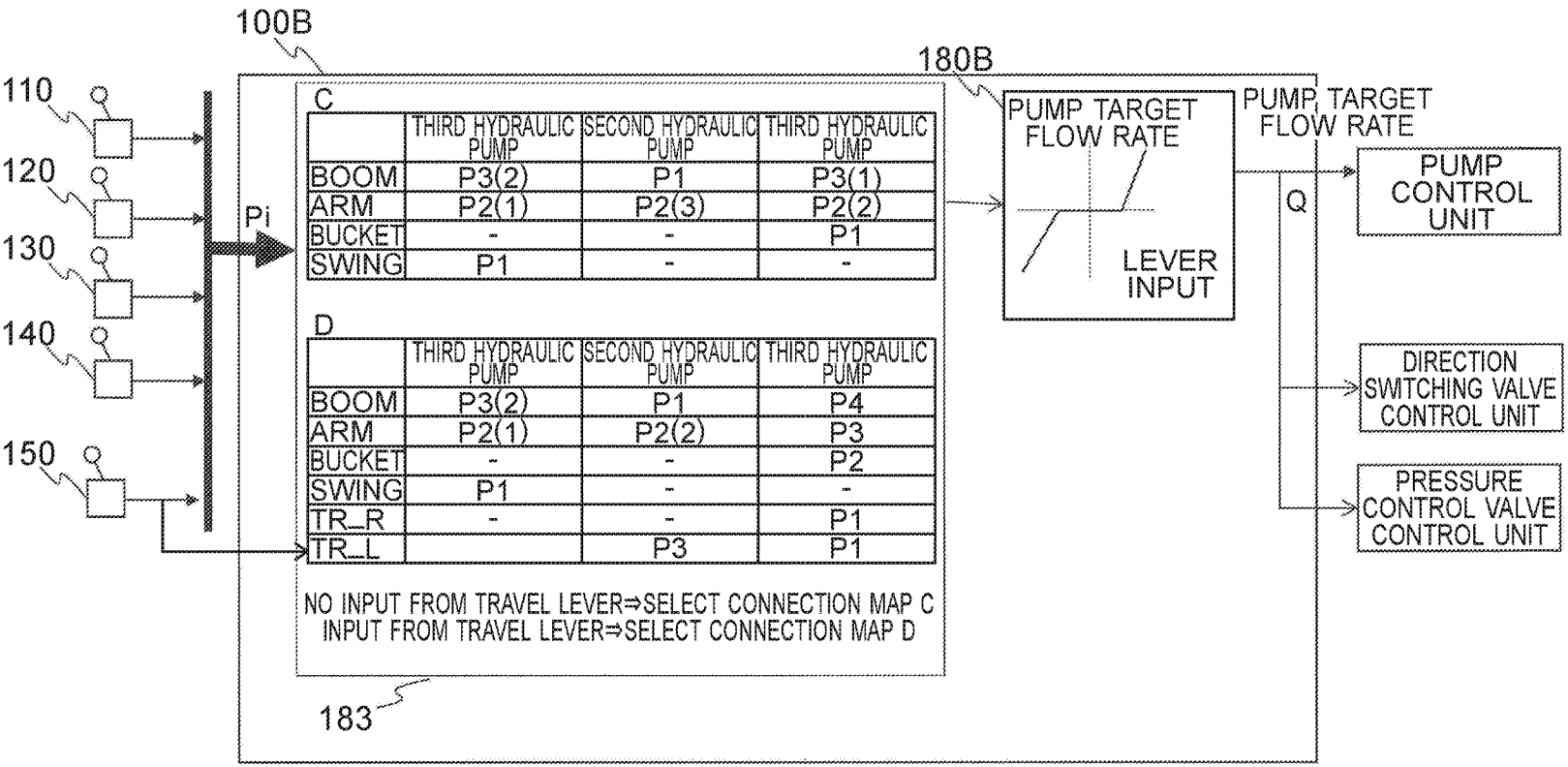
FIG. 7 is a diagram illustrating an example of processing procedure in a controller for the operation of the hydraulic control system according to a third embodiment of the present invention.

FIG. 7 is a diagram illustrating processing procedure in a controller 100B for the operation of a hydraulic control device according to a third embodiment of the present invention. In FIG. 7, a target flow-rate computing unit 180B corresponds to the boom target flow-rate calculator 112, the arm target flow-rate calculator 122, a bucket target flow-rate calculator 132 and the swing target flow-rate calculator 142 in FIG. 3.

The controller 100B configured in the third embodiment of the present invention includes a connection map 183 in which a plurality of pump-actuator connection relationships is stored to correspond to which operating devices of all the operating devices such as the boom operating device 110, the arm operating device 120, the bucket operating device 130, the swing operating device 140, a travel operating device 150 and the like are operated, in short, to correspond to an operation combination. Based on a kind and a signal amount Pi represented by the signal received from the operating device and on the information of the connection map 183, a pump-actuator connection relationship is selected. The remainder is the same as the above second embodiment.

In the third embodiment, for example, when, in the hydraulic excavator, the travel operating device 150 is activated for travel operation of a travel motor which is not shown, the front mechanisms such as the boom, arm, bucket and the like are less likely to be moved concurrently. Because of this, upon reception of the operation signal Pi from the travel operating device 150, the first hydraulic pump 11 is selected for the travel motor (TR-R, TR-L) in preference to the boom, the arm and the bucket as shown in "D" of the connection map 183.

Figure 8:
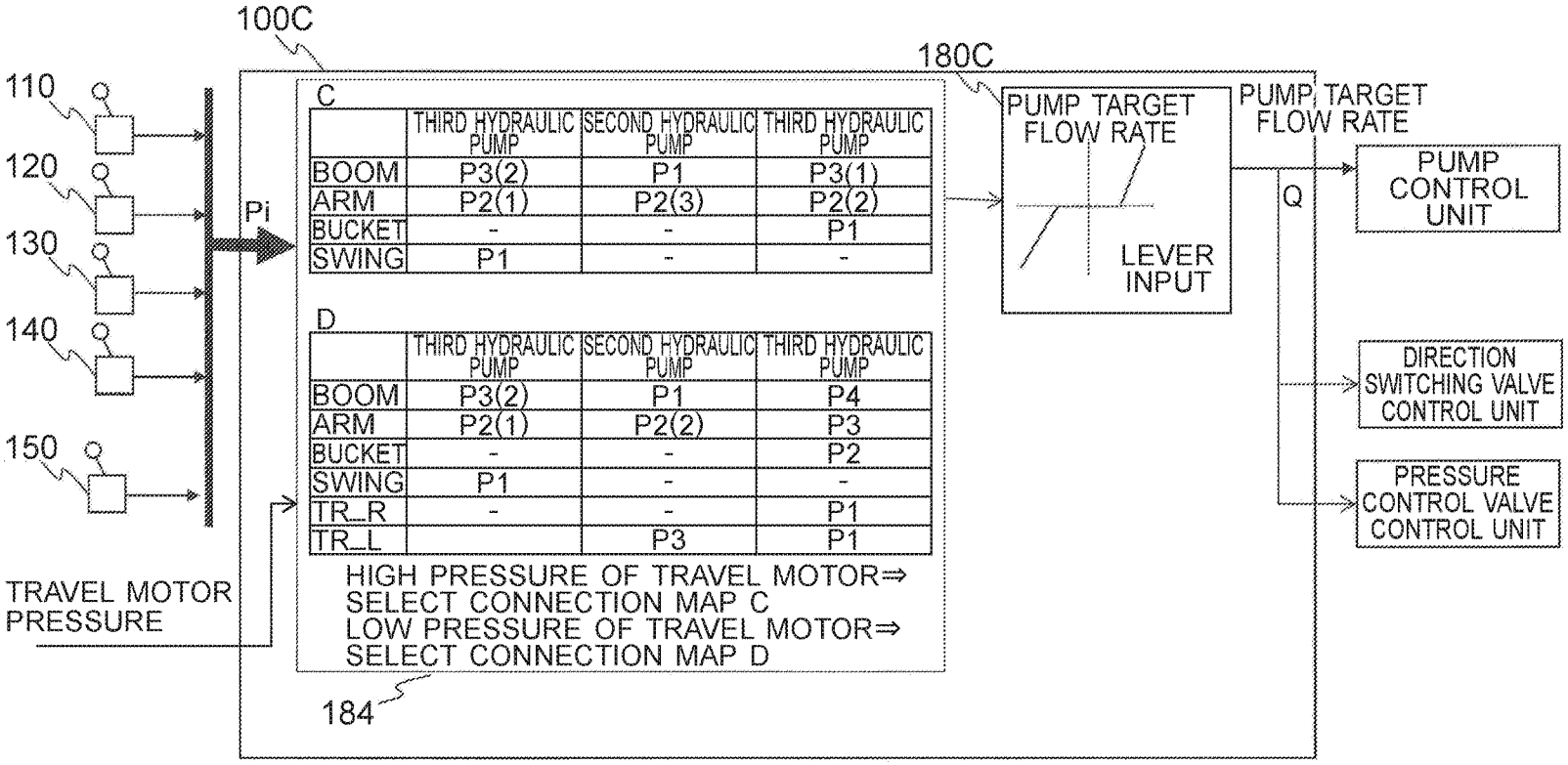
FIG. 8 is a diagram illustrating an example of processing procedure in the controller for the operation of the hydraulic control system according to the third embodiment of the present invention.

Such combined control for travel and the front mechanisms as described above is less likely to be performed. However, for example, when the travel-bucket combined control is instructed and hydraulic oil is supplied from the first hydraulic pump 11 to the travel motor and the bucket cylinder 9 according to "D" in connection map 183, even if the discharge flow rate of the first hydraulic pump 11 is not enough, there is no extreme reduction in speed, because the maximum required flow rate of the bucket cylinder 9 is lower than those of the boom cylinder 7 and the arm cylinder 8. Further, if the travel-boom or travel-arm combined operation is instructed, the first hydraulic pump 11 is selected for travel, the second hydraulic pump 12 is selected for the boom and the third hydraulic pump 13 is selected for the arm. Therefore, the pump discharge flow rate corresponding to the operation signal Pi can be ensured with reliability. Accordingly, the same advantageous effects as the above first embodiment can be provided. Further, instead of the signal of the travel operating device 150 shown in FIG. 7, as shown in FIG. 8, a pressure of the travel motor may be detected, and the detected pressure of the travel motor may be input to the controller 100C. Then, it may be determined that the travel motor is activated when the pressure of oil flowing into the travel motor exceeds a threshold value, and then the connection map 183 may be changed, for example, from "C" to "D".

Fourth Embodiment

Figure 9:
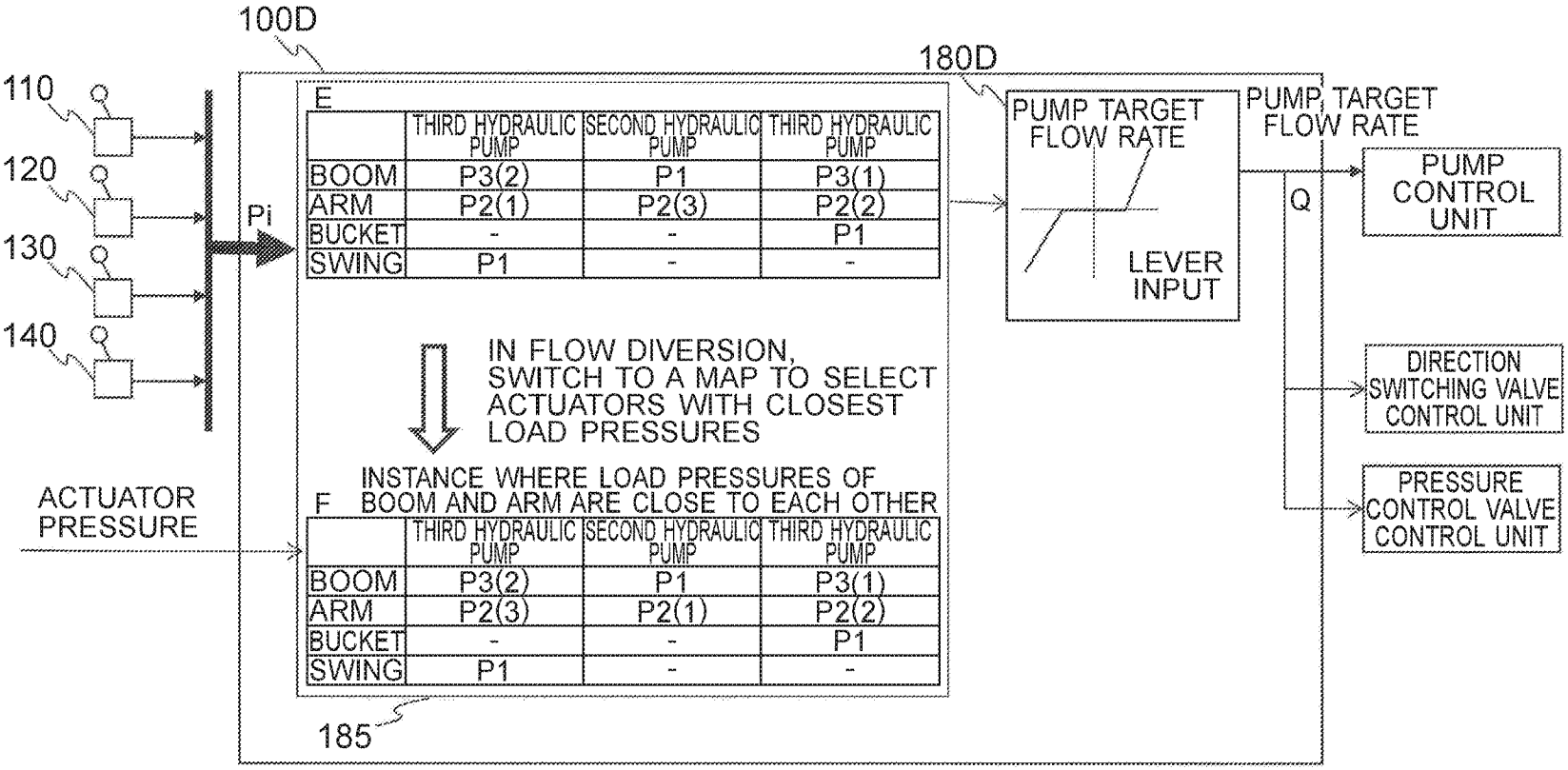
FIG. 9 is a diagram illustrating processing procedure in a controller for the operation of the hydraulic control system according to a fourth embodiment of the present invention.

FIG. 9 is a diagram illustrating processing in a controller 100D for the operation of a hydraulic control device according to a fourth embodiment of the present invention. The controller 100D configured in the fourth embodiment of the present invention is configured to receive signals from the boom operating device 110, arm operating device 120, bucket operating device 130 and the swing operating device 140, as well as load pressure signals from the boom cylinder 7, arm cylinder 8, bucket cylinder 9 and the swing motor 50.

And, if the need to use a single hydraulic pump to drive a plurality of actuators arises, in other words, if the need to divide the oil of the hydraulic pump arises, a comparison of load pressure among the actuators is made and the connection map 185 is changed for use such that the discharge oil is divided and supplied from the single hydraulic pump to the actuators with pressure values closer to each other. The configuration of other components is the same as the first, second and third embodiments.

In the fourth embodiment, for example, as illustrated in FIG. 9, in the case of shifting from the arm-boom-bucket combined control to the arm-boom-bucket-swing combined control, the connection between the bucket cylinder 9 and the first hydraulic pump 11 and the connection between the swing motor 50 and the third hydraulic pump 13 are uniquely determined from the connection map 185. The first priority for the second hydraulic pump 12 is given to the boom cylinder 7, so that the connection relationship between the second hydraulic pump 12 and the boom cylinder 7 is determined. Meanwhile, the arm cylinder 8 is combined with an actuator having the closet load pressure to the pressure of the arm cylinder 8 from among the actuators.

For example, if the pressure of the swing motor 50 is closest to that of the arm cylinder 8, the third hydraulic pump 13 is selected for the arm cylinder 8, or, alternatively, if the pressure of the boom cylinder 7 is closest to that of the arm cylinder 8, the second hydraulic pump 12 is selected as illustrated in FIG. 9. As a result, both the actuators with closet pressures are driven by the hydraulic oil discharged from the same hydraulic pump, making it possible to reduce the pressure loss caused at the directional control valve or the pressure control valve by a pressure difference between the pump discharge pressure and the actuator pressure, and to suppress the shock upon actuation of the directional control valve spool.

Note that the pressure of the actuator may be an actual load pressure measured by a pressure gauge not shown and installed in each oil passage for a supply of hydraulic oil to the actuator, or may be a target drive pressure calculated by the controller 100D.

Fifth Embodiment

Figure 10:
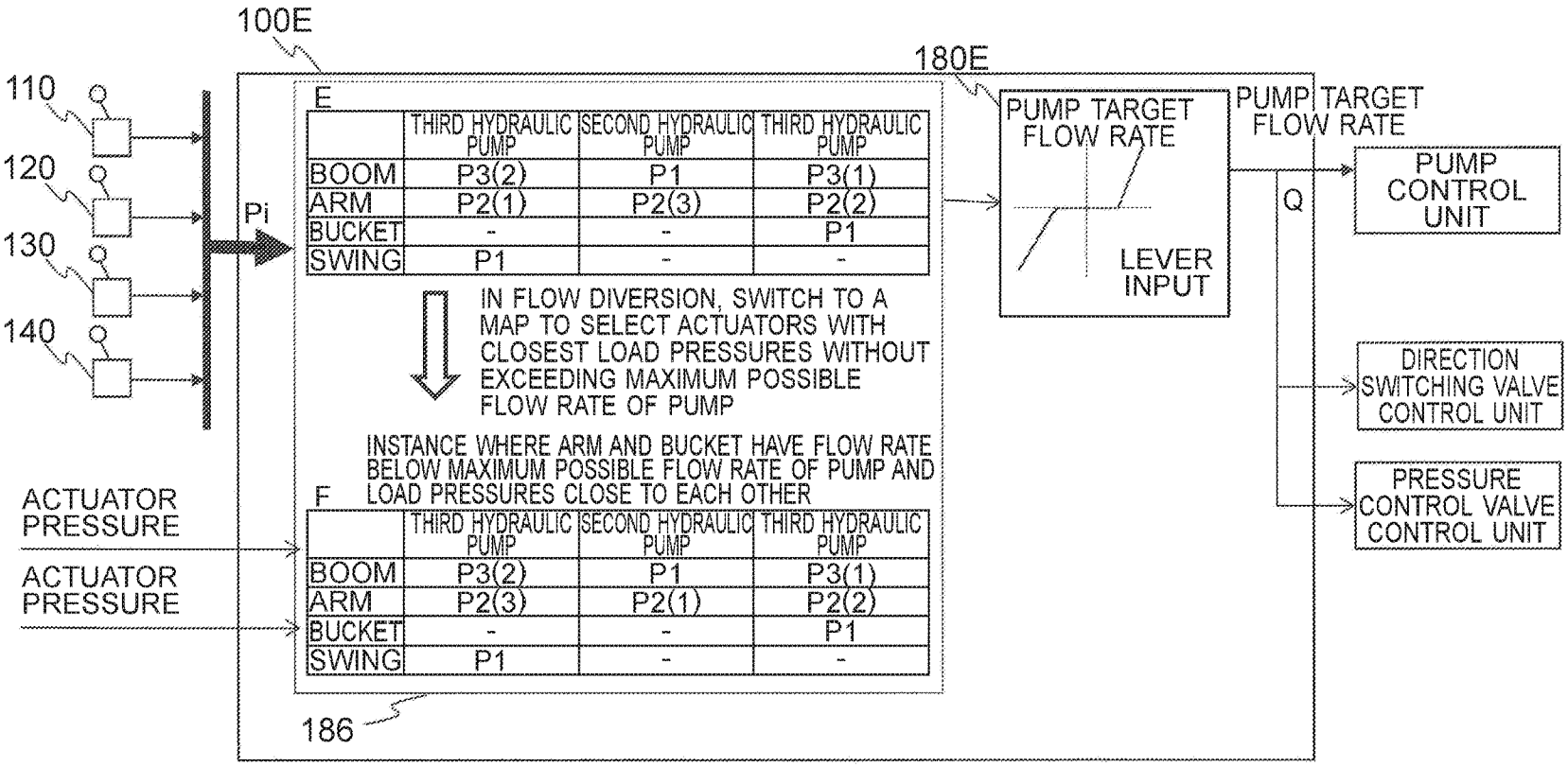
FIG. 10 is a diagram illustrating processing procedure in a controller for the operation of the hydraulic control system according to a fifth embodiment of the present invention.

FIG. 10 is a diagram illustrating processing in a controller 100E for the operation of a hydraulic control device according to a fifth embodiment of the present invention. As illustrated in FIG. 10, the controller 100E is configured to receive signals from the boom operating device 110, arm operating device 120, bucket operating device 130 and the swing operating device 140, as well as information on load pressure of each actuator and a flow rate supplied to each actuator.

And, if the need to use a single hydraulic pump to drive a plurality of actuators arises, in other words, if the need to divide the oil discharged from the hydraulic pump arises, a comparison of flow rates supplied to the respective actuators is made and a combination of some of the actuators is determined such that the total flow rate of the combination is no more than the maximum possible flow rate of the single pump. Within the combination of the actuators, a comparison of load pressure between the actuators is made, and from the connection map 186, it is determined that discharge oil is supplied from the same hydraulic pump to the two actuators with the load pressures closest to each other. Note that if the connection relationships are changed, a target flow-rate calculation unit 180E calculates a target flow rate of the pump on the basis of the changed connection relationship.

In the fifth embodiment, for example, in the case of shifting from the arm-boom-bucket combined control to the arm-boom-bucket-swing combined control, a combination between the bucket cylinder 9 and the first hydraulic pump 11, a combination between the swing motor 50 and the third hydraulic pump 13, and a combination between the boom cylinder 7 and the second hydraulic pump 12 are determined from the information of the connection map 185, as in the case of the fourth embodiment.

For the arm cylinder 8, from among the supply flow rates of the respective actuators, a combination of actuators is determined such that the maximum possible flow rate of a single pump is not exceeded. Then, from among the combinations of the actuators, load pressures of the respective actuators are compared to select a combination of two actuators with the load pressures closest to each other, and it is determined which hydraulic pump is to be connected to the arm cylinder 8 in the selected combination. For example, if the total flow rate of the arm cylinder 8 and the swing motor 50 does not exceed the maximum possible flow rate of the third hydraulic pump 13 and the load pressures of the arm cylinder 8 and the swing motor 50 are closest to each other, the third hydraulic pump 13 is selected for the arm cylinder 8 as illustrated in "E" of the connection map 186.

Meanwhile, if the total flow rate of the arm cylinder 8 and the swing motor 50 exceeds the maximum possible flow rate of the third hydraulic pump 13, another actuator is selected. If the total flow rate of the arm cylinder 8 and the bucket cylinder 9 does not exceed the maximum possible flow rate of the first hydraulic pump 11 and the load pressures of the arm cylinder 8 and the bucket cylinder 9 are closest to each other, the first hydraulic pump 11 is selected for the arm cylinder 8 as illustrated in "F" of the connection map 186 in FIG. 10.

As described above, according to the fifth embodiment, the required flow rate can be supplied to each actuator within the maximum possible flow rate of a hydraulic pump and also two actuators with load pressures closest to each other can be supplied with hydraulic oil from a single hydraulic pump. As a result, the same advantageous effects as those in the fourth embodiment can be obtained. Note that the flow rate of an actuator may be any one of values of: an actual flow rate measured by a flowmeter, not shown, installed in each oil passage through which oil is supplied to the actuator; an estimated flow rate calculated from actuator speed or actuator displacement; and a target flow rate calculated by the target flow-rate calculation unit in the controller 100E.

As described above, in the hydraulic control device for a working machine according to the present invention, for driving of a front working mechanism, swing, travel and the like, there is no so-called bleed-off loss produced by, after a flow rate of hydraulic oil corresponding to an operation signal is discharged from each of the hydraulic pumps, returning the hydraulic oil to a tank on a hydraulic circuit for supply to each actuator without being supplied to the actuator, and/or there is no meter-in loss produced when hydraulic oil is divided and supplied from a single pump to a plurality of actuators. As a result, the hydraulic working machine is able to be driven with a high degree of energy transfer efficiency. Additionally, irrespective of a kind and a combination of actuators to be operated, work details and also a change of attachments for use, the operability can be ensured and also high fuel efficiency can be achieved.

LIST OF REFERENCE SIGNS

11 First pump (hydraulic pump)
12 Second pump (hydraulic pump)
13 Third pump (hydraulic pump)
21 First boom directional control valve
22 Second boom directional control valve
23 Third boom directional control valve
26 First boom pressure control valve
27 Second boom pressure control valve
28 Third boom pressure control valve
31 First arm directional control valve
32 Second arm directional control valve
33 Third arm directional control valve
36 Second arm pressure control valve
37 First arm pressure control valve
38 Third arm pressure control valve
41 Bucket directional control valve
46 Bucket pressure control valve
51 Swing motor directional control valve
46 Swing motor pressure control valve
100 Controller
110 Boom operating device
111 Boom required flow-rate calculator
112 Boom target flow-rate calculator
113 Boom target pressure calculator
114 Boom directional-control-valve control variable calculator
120 Arm operating device
121 Arm required flow-rate calculator
122 Arm target flow-rate calculator
123 Arm target pressure calculator
124 Arm directional-control-valve control variable calculator
130 Bucket operating device
131 Bucket required flow-rate calculator
132 Bucket target flow-rate calculator
133 Bucket target pressure calculator
134 Bucket directional-control-valve control variable calculator
140 Swing operating device
141 Swing required flow-rate calculator
142 Swing target flow-rate calculator
143 Swing target pressure calculator
144 Swing directional-control-valve control variable calculator
150 Travel operating device
151 First pump target pressure calculator
152 Second pump target pressure calculator
153 Third pump target pressure calculator
180 Target flow rate calculation unit
190 Mode selector
182, 183, 185, 186 Connection map

The invention claimed is:

1. A working machine, comprising:

a prime mover;

a plurality of hydraulic pumps driven by the prime mover;

a plurality of actuators driven by hydraulic oil discharged from the plurality of hydraulic pumps;

a plurality of directional control valves, respectively connected in parallel to each of the plurality of hydraulic pumps, for directing the hydraulic oil discharged from one of the hydraulic pumps to a predetermined actuator of the plurality of actuators;

a plurality of speed sensors provided in each of the plurality of actuators;

a plurality of working members, each respectively operated by the plurality of actuators;

a plurality of operating devices that output operation signals representing operation amounts to the plurality of directional control valves;

a controller that receives the operation signals from the plurality of operating devices, then calculates pump control signals for the plurality of hydraulic pumps and valve drive signals for the plurality of directional control valves on the basis of the plurality of operation signals, and then outputs the pump control signals to the plurality of hydraulic pumps, and also outputs the valve drive signals to the plurality of directional control valves;

a plurality of pressure control valves provided upstream of the plurality of directional control valves; and a mode selector for inputting a mode switch signal to the controller; wherein the controller:

calculates a target driving pressure of the actuator from an operation speed of the actuator detected by the speed sensor and a target flow rate of the hydraulic oil supplied to the actuator, controls the pressure control valve provided upstream of the actuator so that the driving pressure of the actuator becomes the target driving pressure, and, for each of the plurality of hydraulic pumps, stores a plurality of maps defining a first priority order which is a priority order of the actuators for supplying the hydraulic oil discharged by the hydraulic pump in accordance with work performed by the work machine, selects a corresponding map from the plurality of maps on the basis of the mode switch signal from the mode selector, and determines which actuator of the plurality of actuators the hydraulic oil discharged by each of the plurality of the hydraulic pumps is supplied to.

2. The working machine according to claim 1, wherein, for the actuator having the first priority order, the map defines a second priority order that is a priority order of the hydraulic pump that supplies the hydraulic oil to the actuator.

3. The working machine according to claim 1, wherein the working machine is a hydraulic excavator including a front member including at least a boom, an arm and an attachment, and a revolving upperstructure, the first precedence order gives the highest priority to a specific hydraulic pump of the hydraulic pumps to allow only the specific hydraulic pump to supply hydraulic oil preferentially to the actuators driving the attachment and the revolving upperstructure, and the first precedence order for the specific hydraulic pump gives a lower priority to the actuators driving the boom and the arm than that to the attachment and revolving upperstructure, and also the second precedence order is set for the actuators driving the boom and the arm.

* * * * *